United States Patent [19]

Barker et al.

[11] 4,370,185

[45] Jan. 25, 1983

[54] TAPE FIXING DEVICE

[75] Inventors: William I. Barker; Ernest J. Denham, both of Johannesburg, South Africa

[73] Assignee: Suspendex (Proprietary) Limited, Johannesburg, South Africa

[21] Appl. No.: 270,724

[22] Filed: Jun. 5, 1981

[30] Foreign Application Priority Data

Jun. 6, 1980 [ZA] South Africa ..... 80/3381

[51] Int. Cl.[3] ..... B65C 9/08

[52] U.S. Cl. ..... 156/565; 156/573

[58] Field of Search ..... 156/564, 565, 573

[56] References Cited

U.S. PATENT DOCUMENTS 460,383 9/1891 Thorp ..... 156/565
540,599 6/1895 Rollandet ..... 156/573
615,394 12/1898 Kraus ..... 156/565
1,443,090 1/1923 Peters ..... 156/573

*Primary Examiner*—David A. Simmons
*Attorney, Agent, or Firm*—Sughrue, Mion, Zinn, Macpeak and Seas

[57] ABSTRACT

The invention relates to a means for affixing tape to an edge of paper comprising a container for storing a stack of adhesive strips, a dispensing opening adjacent one longitudinal edge of the container and biasing means in the container to urge a stack of strips towards the opening; the container having attached thereto mounting means for mounting the container on a support surface, the container being attached to the mounting means such that the opening in the longitudinal edge of the container is movable towards and away from the supporting surface.

5 Claims, 2 Drawing Figures

TAPE FIXING DEVICE

Figure 1:
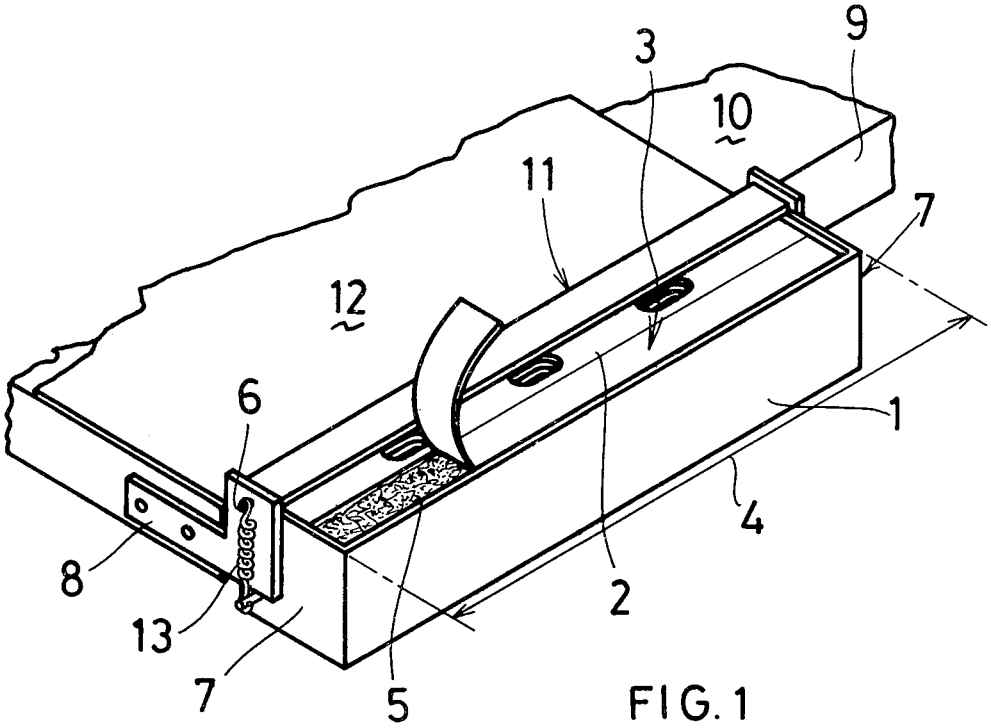

This invention relates to a device used for applying an edge tape to a sheet of paper and more particularly but not exclusively, to drawing paper.

Engineering, architectural and other drawings often require many man hours of work in their preparation and thus obtain a substantial value once completed. It is therefore desirable that the drawings should be well protected so as to avoid damage during storage and use. One method of preventing damage is to affix an edge tape around the edge of the drawing thereby increasing the resistance of the edge of the paper to tearing. A further protection is to suspend each drawing from one of its edges in a vertical filing cabinet.

This requires the affixing to the drawing of a special tape, the tape having holes punched therethrough of standard spacing, through which splines in the cabinet pass in order to support the drawing. To facilitate the application of both types of tape to drawings, the tape is conventionally supplied with a pressure sensitive adhesive surface which when applied to drawings adhesively secures the drawing and tape together.

It will be appreciated that it is important to position the tape correctly on the drawing in order that no section of the adhesive surface sticks out beyond the edge of the paper. If this occurs, drawings tend to stick together, jam in copying machines and otherwise be subjected to damage and mistreatment.

It requires a fair degree of dexterity and skill to position tape correctly on a drawing, especially large sheets of paper which are difficult to handle.

It is the object of this invention to provide a device for affixing tape to the edge of sheets of paper in which the above problems, are at least to a large extent, alleviated.

According to this invention there is provided a means for affixing tape to the edge of paper comprising a container for storing a stack of adhesive strips, a dispensing opening adjacent one longitudinal edge of the container and biasing means in the container to urge a stack of strips towards the opening; the container having attached thereto mounting means for mounting the container on a support surface, the container being attached to the mount such that the opening in the longitudinal edge of the container is movable towards and away from the supporting surface.

Further, there is provided for the container to be pivotally attached at its ends to the mounting means, the pivot location, the widths of the container and opening being such that the container can be rotated to bring the dispensing opening over and against the supporting surface.

Further features of this invention will become apparent from the following description of an example of this invention, given by way of example, wherein reference is made to the accompanying drawings of the device in which:

FIG. 1 in an isometric view of the device, and

Figure 2:
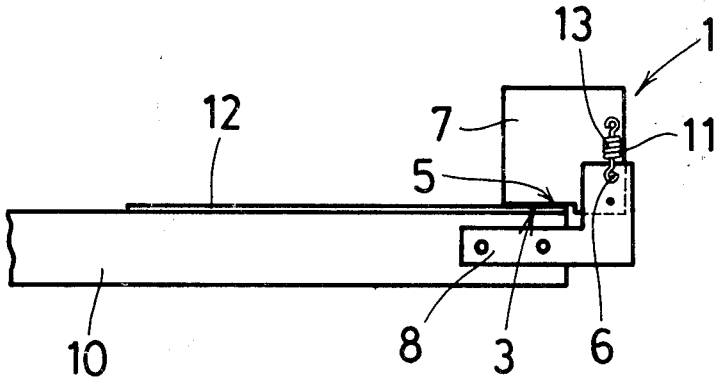

FIG. 2 is an end elevation of the device.

As shown, the device is suitable for attaching perforated supporting strips to the edge of drawings. The device consists essentially of an elongated rectangular container 1. The width and length of the container is such that it will neatly accommodate a stack of adhesive strips 2. These strips are of the type commonly used in drawing offices to provide means whereby drawings can be suspended to hang vertically in filing cabinets. The strips are perforated and have pressure sensitive adhesive along the length of the strips near one edge. The adhesive has a removable protective layer over it.

The container 1 has a loading and dispensing opening 3 for the strips 2 which extends approximately half way across one longitudinal face 4, the other half of said face forming a strip retaining member. Inside the container is a spring loaded plate or the like which urges strips 2 in the container 1 towards the opening 3.

The strips 2 are located in the container 1 so that the outermost strip has its adhesively coated edge 5 located along the length of the opening 3.

The container 1 is pivotally mounted at 6 by its ends 7 to supporting brackets 8. The brackets enable the container to be secured adjacent to the edge 9 of a drawing supporting surface 10. The container 1 and pivot 6 are such that the container may be rotated between two terminal positions.

The first terminal position is illustrated in FIG. 1 where the container extends alongside the edge 9 of surface 10 such that the side 11 of the container abutts and projects slightly above the edge 9. The dispensing opening 3 is upwardly directed and away from the supporting surface 10.

In this position the edge of a drawing 12 can be very easily located to extend accurately along the edge 9 of the supporting surface 10 by pushing it against the side 11 of container 1. Also the protective layer over the adhesively coated edge 5 of the uppermost strip can be readily removed.

To fix the strip 2 to the drawing 12 the container is swung about its pivots into the second terminal position illustrated in FIG. 2. In this position opening 3 is above the supporting surface 10 alongside edge 9 so that the adhesively coated edge of the strip is brought accurately against the edge of the drawing 12. The spring loaded plate in the container provides adequate pressure to ensure that the strip 2 and drawing 12 are secured together.

The drawing 12 is then withdrawn across the supporting surface and thus automatically dispenses the strip 2 from the container 1.

Rotating the container back to the first terminal position places the device ready for re-use.

Springs 13 will preferably be provided to bias the container into each of its terminal positions.

The device is simple and enables strips to be quickly and accurately attached to the edge of drawings.

What we claim as new and desire to secure by Letters Patent is:

1. An apparatus for affixing an edge tape to an aligned edge of a sheet of paper (12) or the like, comprising:

(a) an elongate container (1) for storing a stack of edge tapes in the form of adhesive strips (2), (b) a dispensing opening (3) defined in one longitudinal side of said container, (c) a strip retaining member of said container disposed adjacent said opening, (d) biasing means disposed within said container for urging a stack of strips towards said retaining member, (e) a sheet support member (10), and (f) means (6,7,8) rotatably mounting said container to said support member such that said container may be rotated between a first position whereat the dispensing opening is closely proximate and directly overlies the support member such that an adhesive strip may be applied through said opening to a sheet of paper disposed on said support member, and a second position whereat the container serves as an abutment edge against which a sheet of paper may be positioned to receive an adhesive strip and whereat the dispensing opening is exposed to access to enable the removal of a protective covering overlying an adhesive surface of a top one of said strips.

2. An apparatus as claimed in claim 1, wherein the container is pivotally connected to the mounting means and is rotatable about an axis which is parallel to its longitudinal axis.

3. An apparatus as claimed in claims 1 or 2, wherein the container is inverted in being rotated between the first and second positions in use.

4. An apparatus as claimed in claims 1 or 2, wherein the dispensing opening and retaining member are shaped to only allow the removal of an individual adhesive strip in a direction generally parallel to the plane of the strip.

5. An apparatus as claimed in claim 3, wherein the dispensing opening and retaining member are shaped to only allow the removal of an individual adhesive strip in a direction generally parallel to the plane of the strip.

* * * * *